US007747211B2

(12) United States Patent
Awano

(10) Patent No.: US 7,747,211 B2
(45) Date of Patent: Jun. 29, 2010

(54) BOOKLET LOADING APPARATUS, POST-TREATMENT APPARATUS, AND IMAGE FORMING SYSTEM

(75) Inventor: Hiroaki Awano, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 346 days.

(21) Appl. No.: 11/480,875

(22) Filed: Jul. 6, 2006

(65) Prior Publication Data

US 2007/0097798 A1 May 3, 2007

(30) Foreign Application Priority Data

Oct. 31, 2005 (JP) ..... 2005-316656

(51) Int. Cl.
*B65H 37/06* (2006.01)
*B65H 31/26* (2006.01)
*B65H 37/04* (2006.01)
*B65H 35/04* (2006.01)

(52) U.S. Cl. ..... 399/408; 271/220; 271/221; 271/902

(58) Field of Classification Search ..... 271/220–221, 271/207, 264, 902; 399/124–125, 405, 408; 270/37, 59.11
See application file for complete search history.

(56) References Cited

U.S. PATENT DOCUMENTS 6,699,005 B2 * 3/2004 Askins ..... 414/788.3

FOREIGN PATENT DOCUMENTS

| | | | |
|---|---|---|---|
| JP | 2000-103567 | * | 4/2000 |
| JP | 2000-153958 | | 6/2000 |
| JP | 2000-255882 | | 9/2000 |
| JP | 3370284 B | | 11/2002 |

* cited by examiner

*Primary Examiner*—Judy Nguyen
*Assistant Examiner*—Marissa L Ferguson-Samreth
(74) *Attorney, Agent, or Firm*—Morgan, Lewis & Bockius LLP

(57) ABSTRACT

A booklet loading apparatus has a carry-out unit that sequentially carries out plural booklets to a predetermined carry-out position; a transfer unit that sequentially arranges the booklets carried out from the carry-out unit while the booklets overlap one another, the transfer unit transferring the booklets in a predetermined transfer direction, the transfer unit returning the booklet to an upstream side in the transfer direction once in each time when the booklet is carried out from the carry-out unit, then the transfer unit transferring the booklet in the transfer direction; a loading unit on which the booklet carried out by the transfer unit is loaded; and an orientation correcting unit arranged on the upstream side in the transfer direction with respect to the transfer position, the orientation correcting unit correcting an orientation of the booklet to a predetermined orientation by causing the booklet to abut on the orientation correcting unit.

8 Claims, 9 Drawing Sheets

BOOKLET LOADING APPARATUS, POST-TREATMENT APPARATUS, AND IMAGE FORMING SYSTEM

BACKGROUND (i) Technical Field

The present invention relates to a booklet loading apparatus on which plural booklets are loaded, a post-treatment apparatus, and an image forming system.

(ii) Description of the Related Art

Conventionally there is well known a booklet loading apparatus which is included in an image forming system typified by a printer or a copying. The loading apparatus is connected to the printer, and the loading apparatus accommodates folding sheets printed and bound while the folding sheets are loaded on the loading apparatus. The loading apparatus includes a belt conveyer which conveys the folding sheets after cutting. In the loading apparatus, an increase in loading capacity is achieved by accommodating the sheets in the belt conveyer.

FIG. 9 is a view showing a state in which the booklet is loaded by a conventional booklet loading apparatus. Part (a) to Part (d) of FIG. 9 show the state in which the booklet is loaded as time advances. Part (a) to Part (c) of FIG. 9 are both a plan view showing a part of the loading apparatus and a plan view of the loading apparatus.

A conventional loading apparatus 500 includes a carry-out roller 511, a transfer belt 512, and a loading tray 513. The carry-out roller 511 sequentially carries out the booklets. The transfer belt 512 transfers the booklet. The loading tray 513 raises the booklet, and the booklet is loaded on the loading tray 513. In Part (a) of FIG. 9, a first booklet P501 is already carried out from a carry-out roller 511 and loaded on a transfer belt 512, and a second booklet P502 is being carried out from a carry-out roller 511. The transfer belt 512 is moved by a predetermined distance in synchronization with timing at which the booklet is carried out from the carry-out roller 511. Therefore, the carried-out booklets are arranged on the carry-out roller 511 while overlapping one another.

The booklet carried out from the carry-out roller 511 is bound by folding the plural sheets into two half-divisions, and the booklet usually has a bulge near a back. The thickness of the booklet by the bulge frequently has deviation in a direction along the back. Therefore, in the loading apparatus 500, when the booklet P502 is loaded while overlapping the booklet P501, the booklet P502 is loaded while inclined as shown in Part (b) of FIG. 9. Then, a booklet P503 carried out in Part (c) of FIG. 9 is loaded while inclined by the same principle as the second booklet P502. As shown in Part (d) of FIG. 9, because an orientation of the each loaded booklet is shifted from one another, disturbing the alignment of the booklet, the booklet to easily drops out. When the carry-out of the booklet is continued to load the booklet while the booklet is raised by the loading tray 513, a situation which the booklet falls or drops out is further easily generated. Accordingly, an amount of loadable booklet is remarkably restricted. Appearance of the loading state is degraded when viewed from a user.

SUMMARY

According to an aspect of the invention, a booklet loading apparatus of the invention has a carry-out unit that sequentially carries out plural booklets to a predetermined carry-out position; a transfer unit that sequentially arranges the booklets carried out from the carry-out unit while the booklets overlap one another, the transfer unit transferring the booklets in a predetermined transfer direction, the transfer unit returning the booklet to an upstream side in the transfer direction once in each time when the booklet is carried out from the carry-out unit, then the transfer unit transferring the booklet in the transfer direction; a loading unit on which the booklet carried out by the transfer unit is loaded; and an orientation correcting unit that is arranged on the upstream side in the transfer direction with respect to the transfer position, the orientation correcting unit correcting an orientation of the booklet to a predetermined orientation by causing the booklet to abut on the orientation correcting unit.

BRIEF DESCRIPTION OF THE DRAWINGS

Exemplary embodiments of the present invention will be described in detail based on the following figures, wherein.

DETAILED DESCRIPTION

A booklet loading apparatus according to an embodiment of the invention will be described below with reference to the drawings.

Figure 1:
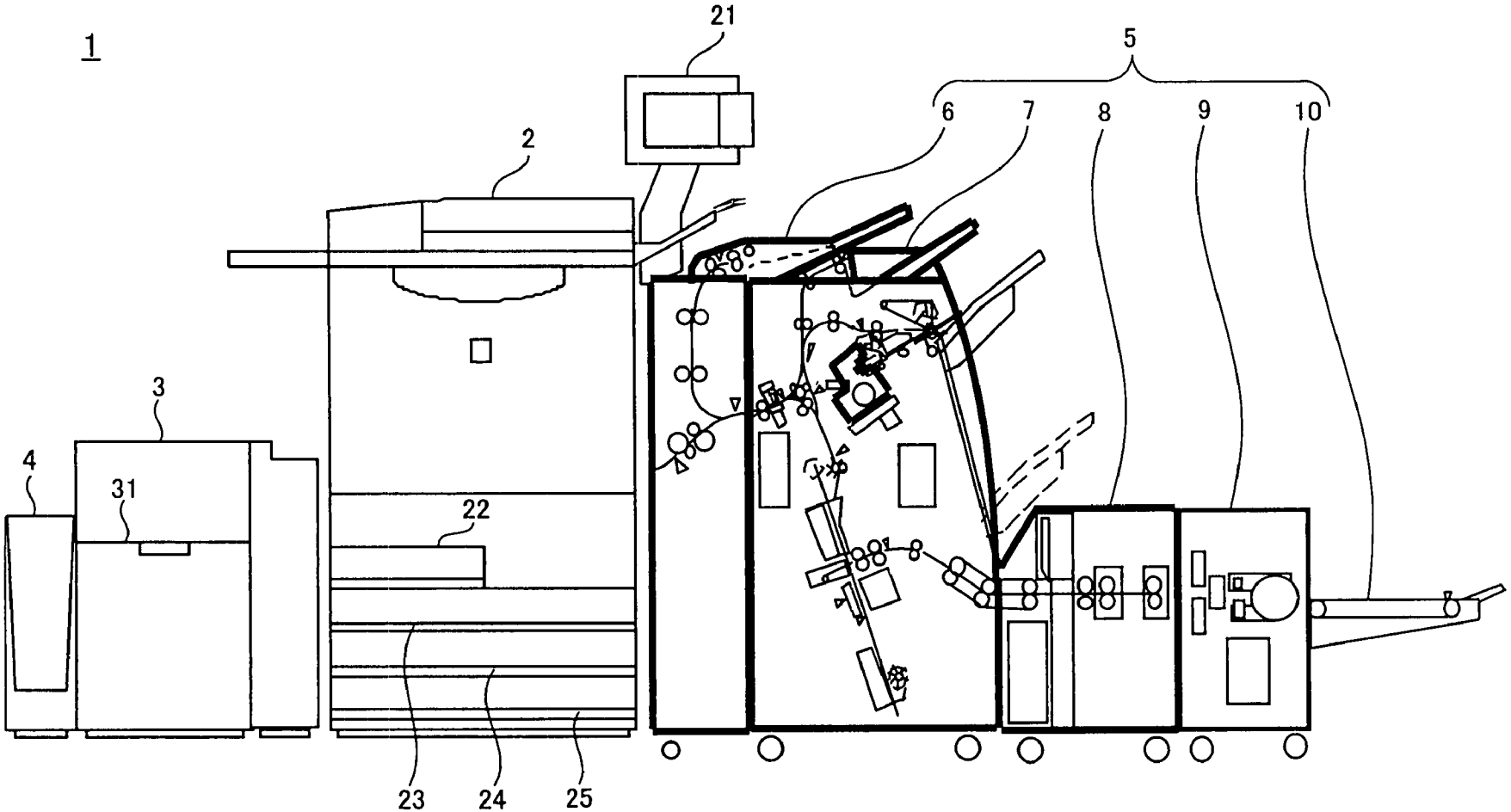
FIG. 1 shows an image forming system into which a booklet loading apparatus according to an embodiment of the invention is incorporated.

FIG. 1 shows an image forming system into which a booklet loading apparatus according to an embodiment of the invention is incorporated.

An image forming system 1 includes an image forming apparatus 2 and a post-treatment apparatus 5. The image forming apparatus 2 forms the image on the sheet, and the post-treatment apparatus 5 performs the post-treatment to the sheet on which the image is formed by the image forming apparatus 2. A large-capacity sheet feeder 3 and a print server 4 are connected to the image forming apparatus 2. The large-capacity sheet feeder 3 has a sheet tray 31 in which a large number of sheets are stored, and the print server 4 assists a printing function of the image forming apparatus 2.

The image forming apparatus 2 includes an operation panel 21 and sheet trays 22, 23, 24, and 25. A user inputs information to the image forming apparatus 2 using the operation panel 21, and the different kinds of sheets are stored in the sheet trays 22, 23, 24, and 25 respectively. Pieces of bookbinding information are inputted from the operation panel 21. Examples of the bookbinding information include attributes of the sheets stored in the sheet trays 22 to 25 and an inserter 6 respectively, selection of the sheets used in forming the image, and presence or absence of cutting and aligning of the bound booklet.

The post-treatment apparatus 5 includes the inserter 6, a booklet finisher 7, a trimming machine 8, a square folding device 9, and a stacker 10. The inserter 6 additionally inserts a cover. The booklet finisher 7 binds the sheets to perform saddle stitching, and the booklet finisher 7 folds the sheets to produce the booklet. The trimming machine 8 cuts and aligns sides of the booklet. The square folding device 9 performs a square folding process of evenly forming the back of the booklet. The booklets are loaded on the stacker 10. The booklet finisher 7, the trimming machine 8, and the square folding device 9 constitute an example of the bookbinding unit described in the invention.

Figure 2:
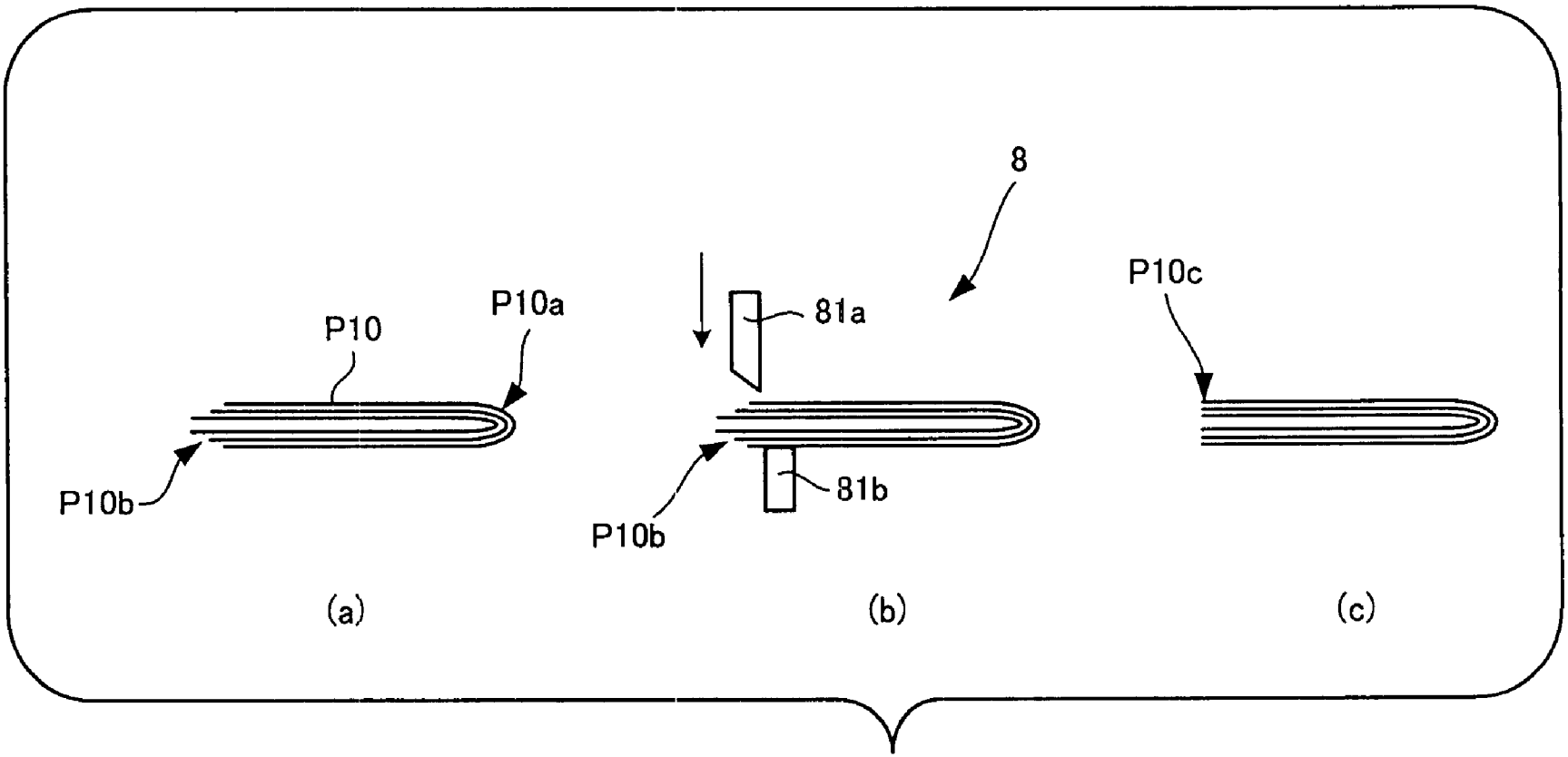
FIG. 2 is a schematic view showing a function of a trimming machine included in the image forming system shown in FIG. 1.

FIG. 2 is a schematic view showing a function of the trimming machine included in the image forming system shown in FIG. 1.

Immediately after a booklet P10 is produced by the booklet finisher 7, the sheets constituting the booklet are not aligned at an edge P10*b* of the booklet as shown in Part (a) of FIG. 2. The trimming machine 8 includes cutters 81*a* and 81*b*, and the cutters 81*a* and 81*b* cut down the edge P10*b* on the sides of the booklet as shown in Part (b) of FIG. 2. Therefore, the edge P10*b* of the booklet is cut and aligned as shown in Part (c) of FIG. 2. A user can select the operation whether or not the side of the booklet is cut and aligned with the trimming machine 8. The trimming machine 8 corresponds to a part of the trimming unit described in the invention.

The square folding device 9 sandwiches the booklet such that the back of the booklet is projected, and the square folding device 9 evenly forms the roller by breaking down the projected back. Usually the square folding device 9 evenly forms the back by moving the back while pressing the roller against the back. As described later, the carry-out roller that carries out the booklet onto the stacker 10 is incorporated into the square folding device 9.

Figure 3:
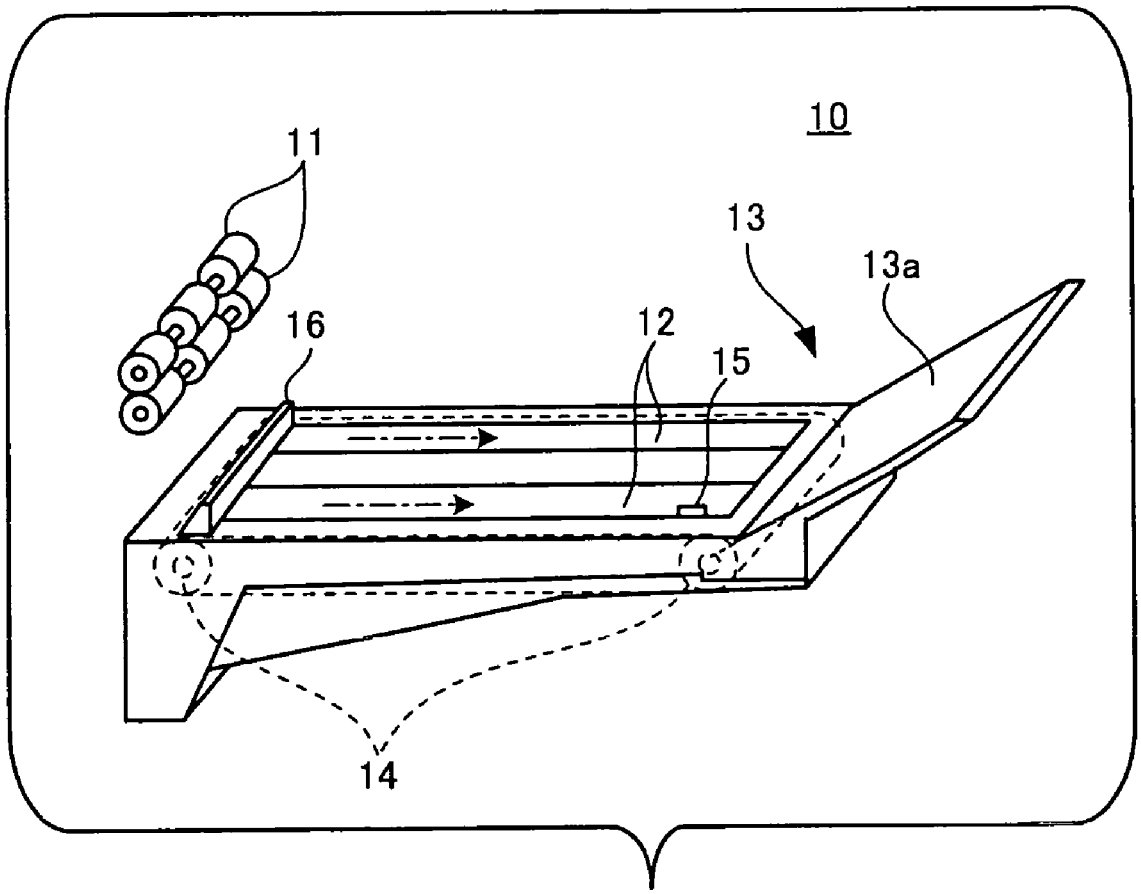
FIG. 3 is a perspective view showing a stacker included in the image forming system shown in FIG. 1.

FIG. 3 is a perspective view showing the stacker included in the image forming system shown in FIG. 1.

FIG. 3 also shows the carry-out roller 11 incorporated into the square folding device 9. The carry-out roller 11 sequentially carries out the booklets passing through the square folding device 9 on the stacker 10.

The stacker 10 includes a loading tray 13 on which the booklets are loaded. The loading tray 13 has a rectangular portion arranged on an upper surface of the stacker 10 and a rising portion 13*a* that extends obliquely upward from one side of the rectangular portion. Two transfer belts 12 that transfer the booklet are provided inside the rectangular portion of the loading tray 13. Each of the transfer belts 12 is tensioned by two drive rollers 14. The upper surface of the transfer belt 12 is moved when the drive roller 14 is driven by a motor (not shown).

The booklet sequentially carried out from the carry-out roller 11 drops on the transfer belt 12. A position on which the booklet drops is referred to as carry-out position. The transfer belt 12 is intermittently moved from the carry-out roller 11 in synchronization with a timing when one booklet is carried out. The booklet on the transfer belt 12 is transferred toward the direction of the rising portion 13*a* of the loading tray 13 according to the movement of the transfer belt 12. The transfer direction is shown by an arrow of FIG. 3.

An orientation correcting unit 16 is attached near a front end on the upstream side in the transfer direction of the transfer belt 12, namely, on the upstream side of the carry-out position. The orientation correcting unit 16 is a rod-shaped member having a surface perpendicular to the transfer direction, and the orientation correcting unit 16 is arranged across the transfer belt 12. When the booklet on the transfer belt 12 is returned from the carry-out position to the upstream side in the transfer direction, the booklet abuts on the surface of the orientation correcting unit 16 that is perpendicular to the transfer direction. Therefore, the orientation of the booklet is corrected such that the side of the booklet abutting on the orientation correcting unit 16 becomes perpendicular to the transfer direction.

The transfer belt 12 returns the booklet to the upstream side in the transfer direction once in each time when the booklet is carried out from the carry-out roller 11, and then the transfer belt 12 transfers the booklet in the transfer direction. The detailed transfer will be described later. As a result of the sequence of the operations, a distance in which the transfer belt 12 transfers the booklet is smaller than a width of the booklet. Therefore, the plural booklets sequentially carried out from the carry-out roller 11 are arranged on the transfer belt 12 while overlapping one another, and the transfer belt 12 transfers the booklets in this state of things. The transfer belt 12 corresponds to an example of the transfer unit described in the invention. A combination of the loading tray 13 and the transfer belt 12 constitutes an example of the loading unit. The carry-out roller 11 corresponds to an example of the carry-out unit described in the invention.

Then, while the first booklet which is transferred in the transfer direction shown by the arrow by the transfer belt 12 is loaded so as to run on the rising portion 13*a* of the loading tray 13, the first booklet is raised along the rising portion 13*a*. After that, the transferred booklet is raised along the surface of the previously transferred booklet while loaded so as to run on the previously transferred booklet. Thus, in the booklet transferred by the transfer belt 12, the movement is regulated and raised by the loading tray 13, and the raised booklet is sequentially loaded while supported by the transfer belt 12. The booklets are loaded in a high dense state while raised.

In the transfer belt 12, a sensor 15 that detects the booklet is arranged near the front end in the direction in which the booklet is transferred. The sensor 15 detects that the first booklet arranged on the transfer belt 12 reaches a neighborhood of the front end of the transfer belt 12. After the sensor 15 detects the booklet, the number of booklets carried out from the carry-out roller 11 is counted as a loading amount of booklet.

Figure 4:
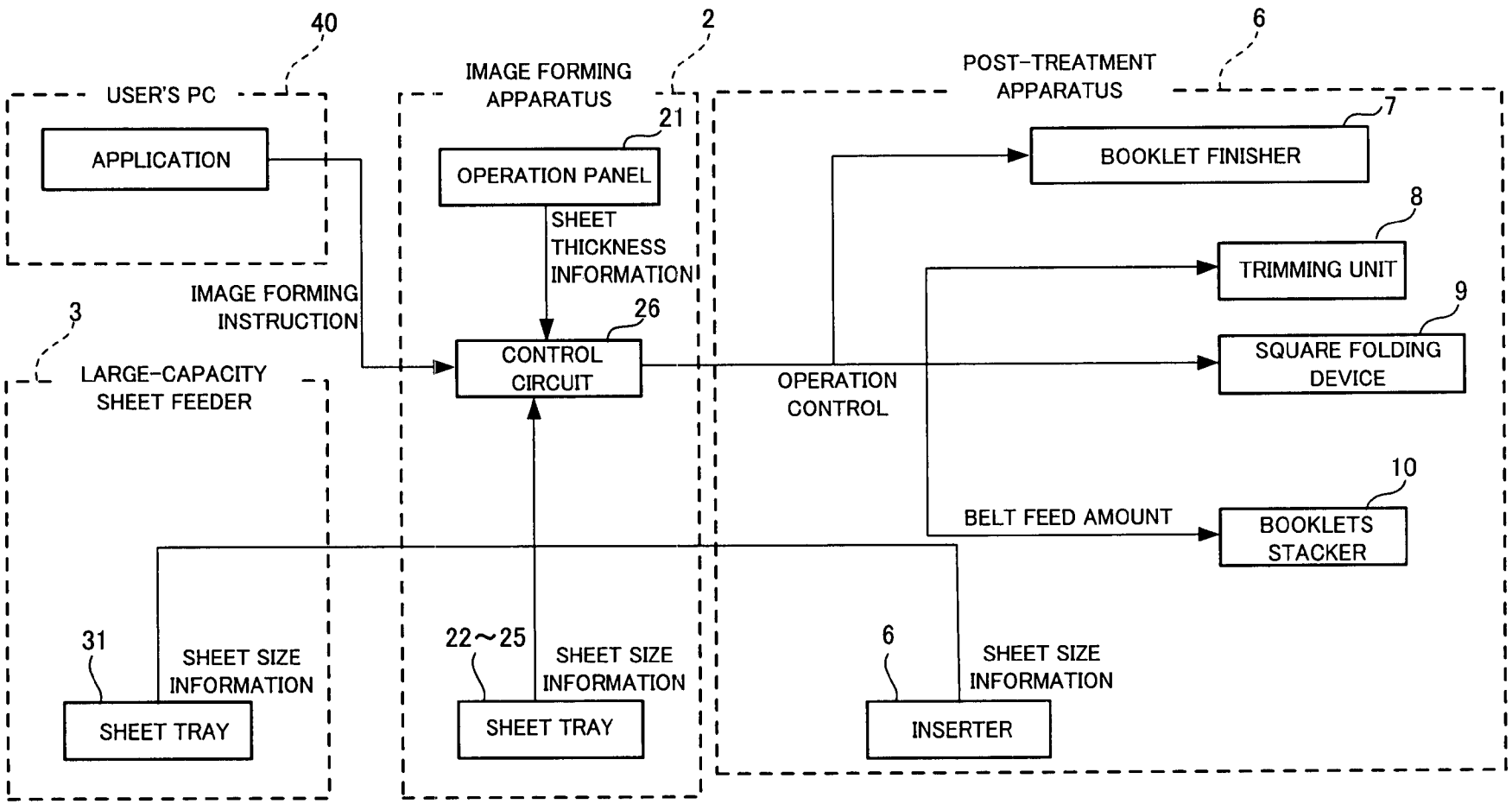
FIG. 4 is a block diagram showing an electrical configuration of the image forming system shown in FIG. 1.

FIG. 4 is a block diagram showing an electrical configuration of the image forming system shown in FIG. 1.

The image forming apparatus 2 includes a control circuit 26 that controls the operation of the whole of the image forming system. The control circuit 26 has a central processing unit (CPU) (not shown) that controls the operation of the whole of the image forming system based on a program, ROM (not shown) in which the program and a table are stored, RAM (not shown) that temporarily provides a storage area to CPU, and an interface circuit (not shown) that relays a signal between CPU and the outside of the control circuit 26. A personal computer 40 of a user is externally connected to the image forming apparatus 2.

The control circuit 26 displays a message on an operation panel 21 in advance of start of the image formation. The message encourages the user to input pieces of information for expressing a size of the sheet constituting the booklet, the number of sheets, and a kind of the bookbinding such as the presence or absence of the cut and alignment by the trimming machine 8. When the user inputs the information by operating the operation panel 21, the inputted information is supplied from the operation panel 21 to the control circuit 26. Therefore, the control circuit 26 obtains the pieces of information expressing the size of the sheet constituting the booklet, the number of sheets, and the kind of the bookbinding from the user.

When an image forming instruction is transmitted to the control circuit 26 from the operation panel 21 or from the externally connected personal computer 40 of the user, the control circuit 26 controls the image forming apparatus 2 to form the image on the sheet. At the same time, the control circuit 26 controls the operations of the booklet finisher 7, the trimming machine 8, the square folding device 9, and the stacker 10. For example, the control circuit 26 controls the drive of the carry-out roller 11 incorporated in the square folding device 9. The control circuit 26 controls rotation of a motor that drives the drive roller 14 of the stacker 10, which moves the transfer belt 12 to transfer the booklet. The control circuit 26 also controls the operation of the trimming machine 8 according to the information obtained from the user. The control circuit 26, the stacker 10, and the carry-out roller 11 constitute an example of the booklet loading apparatus as described in the present invention.

Figure 5:
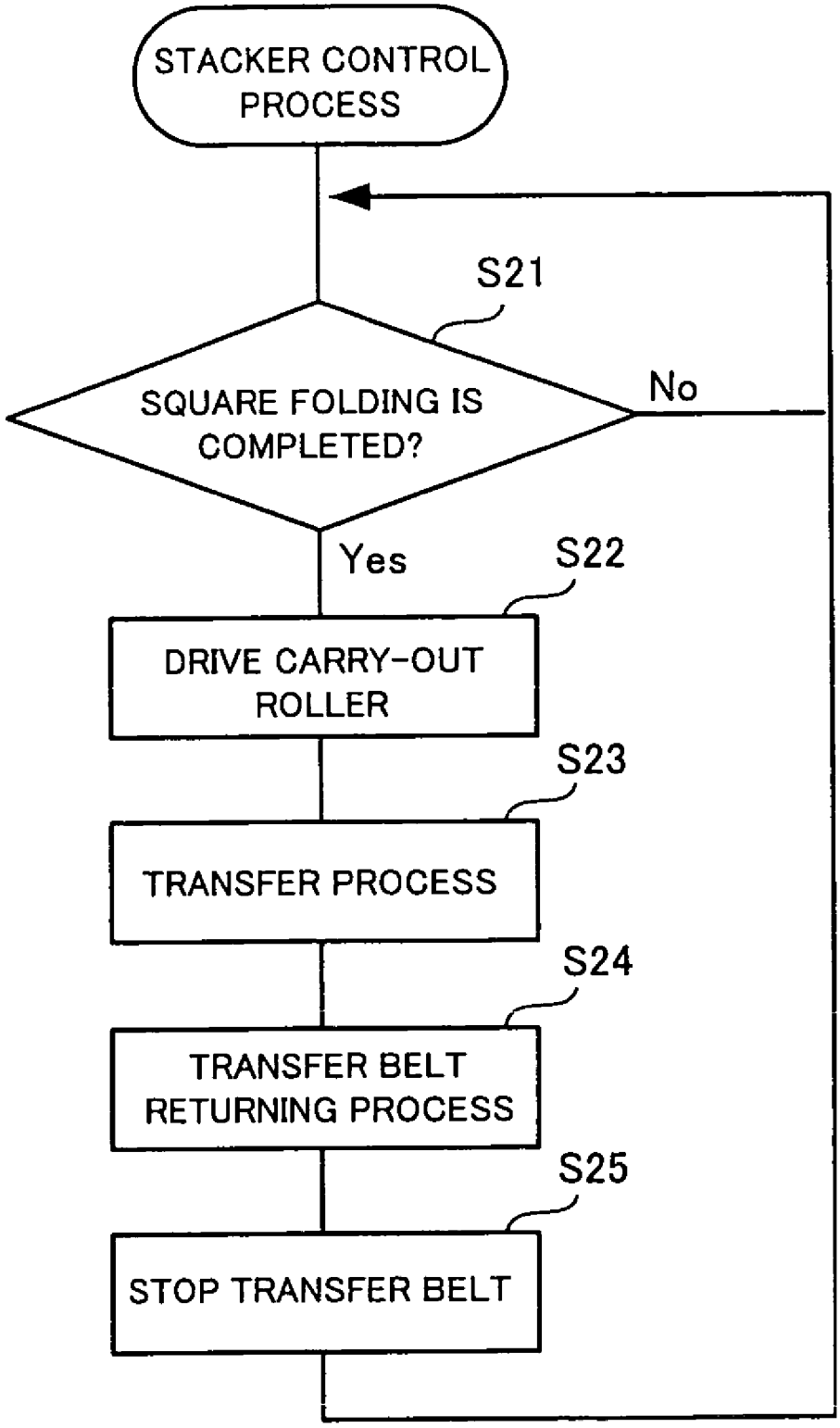
FIG. 5 is a flowchart showing a stacker control process.

FIG. 5 is a flowchart showing a stacker control process.

When the image forming instruction is transmitted to the control circuit 26 from the operation panel 21 or from the externally connected personal computer 40 of the user, the control circuit 26 controls the operations of the image forming apparatus 2, the booklet finisher 7, the trimming machine 8, and the square folding device 9 to perform the image formation on the sheet and the bookbinding. Therefore, the specified number of booklets is bound. The stacker control process shown in FIG. 5 is a part of the image forming and bookbinding process, and the stacker control process is performed in each time when the process of the one booklet is completed by the square folding device 9.

In the stacker control process, it is determined whether or not the square folding process is completed by the square folding device 9 (Step S21). When it is determined that the square folding process is completed (Yes in Step S21), the carry-out roller 11 is driven to start the carry-out of the booklet (Step S22). Then, the transfer belt 12 is moved in the transfer direction for a predetermined time (Step S23). Therefore, the booklet on the transfer belt 12 is transferred in the transfer direction. During the process, the booklet started for the carry-out in the process of Step S22 is completely carried out from the carry-out roller 11, and the booklet drops on the carry-out position of the transfer belt 12. Then, the transfer belt 12 is returned (Step S23). At this point, the transfer belt 12 is moved in the direction opposite to the transfer direction in Step S22. Therefore, the booklet is once returned to the upstream side in the transfer direction to abut on the orientation correcting unit 16. After a predetermined time elapses, the movement of the transfer belt 12 is stopped (Step S25). Then, the processes from Step S21 are repeated. Through the sequence of processes, the transfer belt 12 returns the booklet to the upstream side in the transfer direction once in each time when the booklet is carried out from the carry-out roller 11, and then the transfer belt 12 transfers the booklet in the transfer direction.

Figure 6:
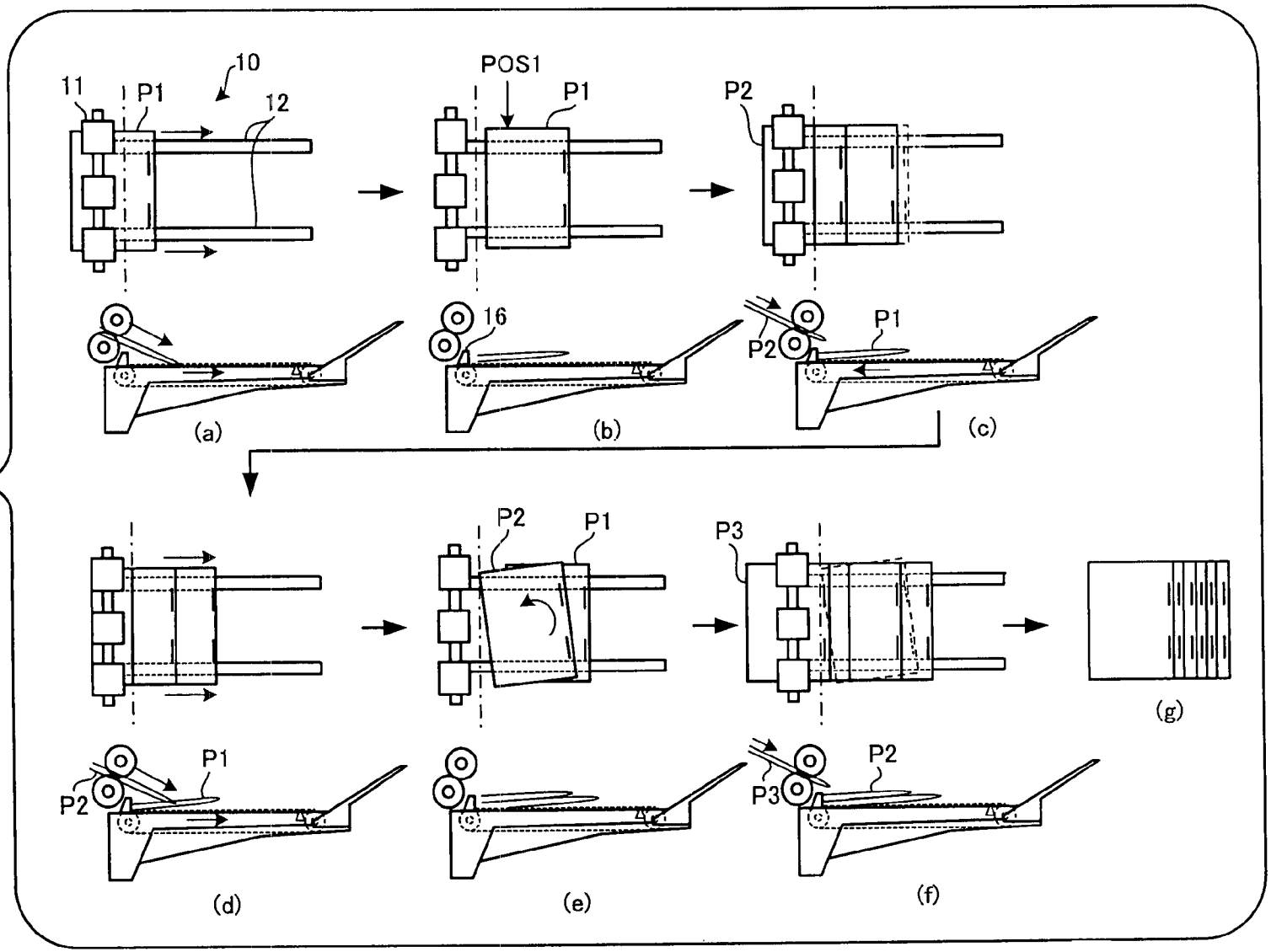
FIG. 6 is a view showing a state in which a booklet is being loaded on the stacker.

FIG. 6 is a view showing a state in which the booklet is being loaded on the stacker.

Part (a) to Part (g) of FIG. 6 show the state in which the booklet is loaded on the stacker 10. Part (a) to Part (f) of FIG. 6 are both a plan view showing a part of the booklet loading apparatus and a front view of the booklet loading apparatus.

As shown in Part (a) of FIG. 6, when the booklet is carried out from the carry-out roller 11 of the square folding device 9, the transfer belt 12 start the movement in synchronization with a timing when the booklet is carried out. The carry-out roller 11 carries out the booklet P1 while the back of the booklet P1 is orientated toward the transfer direction, namely, while the edge is orientated toward the upstream side in the transfer direction. In the case where the side of the booklet is cut and aligned by the trimming machine 8, the cut and aligned edge is orientated toward the upstream side in the transfer direction.

As shown in Part (b) of FIG. 6, the booklet P1 separated from the carry-out roller 11 drops on a carry-out position POS1 on the transfer belt 12.

Then, as shown in Part (c) of FIG. 6, the transfer belt 12 is moved once in the direction opposite to the transfer direction. Therefore, the booklet P1 on the transfer belt 12 is once returned to the upstream side in the transfer direction to abut on the orientation correcting unit 16. When the booklet P1 abuts on the orientation correcting unit 16, the orientation of the booklet P1 is corrected to the orientation in which the side abutting on the orientation correcting unit 16 is perpendicular to the transfer direction.

When the second booklet P2 is carried out by the carry-out roller 11, the transfer belt 12 transfers the booklet P1 in the transfer direction as shown in Part (d) of FIG. 6. Then, the second booklet P2 is separated from the carry-out roller 11, and the booklet P2 is arranged on the booklet P1 while overlapping the booklet P1 (Part (e) of FIG. 6). At this point, because the bulge near the back of the booklet P1 has the deviation along the back direction, the orientation of the booklet P2 overlapping the booklet P1 is shifted from the orientation of the booklet P1.

Then, before the third booklet P3 is carried out from the carry-out roller 11, the booklet P2 is once returned to the upstream side in the transfer direction by moving the transfer belt 12 once in the direction opposite to the transfer direction, and the booklet P2 abuts on the orientation correcting unit 16 (Part (f) of FIG. 6). Therefore, the orientation of the shifted booklet P2 is corrected to the orientation in which the side abutting on the orientation correcting unit 16 is orientated to the direction perpendicular to the transfer direction, namely, to the same orientation as the booklet P1.

Thus, in each time when the booklet is carried out from the carry-out roller 11, the transfer belt 12 returns the booklet to the upstream side in the transfer direction once to cause the booklet to abut on the orientation correcting unit 16, and then the transfer belt 12 transfers the booklet in the transfer direction. Therefore, the orientations of all the booklets carried out from the carry-out roller 11 are corrected and aligned to a predetermined direction. As a result, as shown in Part (g) of FIG. 6, because the alignment state of the loaded booklets are kept well, the drop-out of the booklet is prevented. Therefore, the large number of booklets can be loaded.

The case, in which the sheet folding position passes exactly through the center of the sheets and is parallel to the side of the booklet, is described above in the booklet bound by folding the sheets at the mid point. However, in the booklet finisher 7, sometimes there is a variation in accuracy of the sheet folding position. Both the case where the side is not cut nor aligned by the trimming machine 8 and the case where the side is cut and aligned by the trimming machine 8 will be described below for the loading of the booklet in which the sheets are not aligned at the edge of the booklet due to the low accuracy of the sheet folding position.

Figure 7:
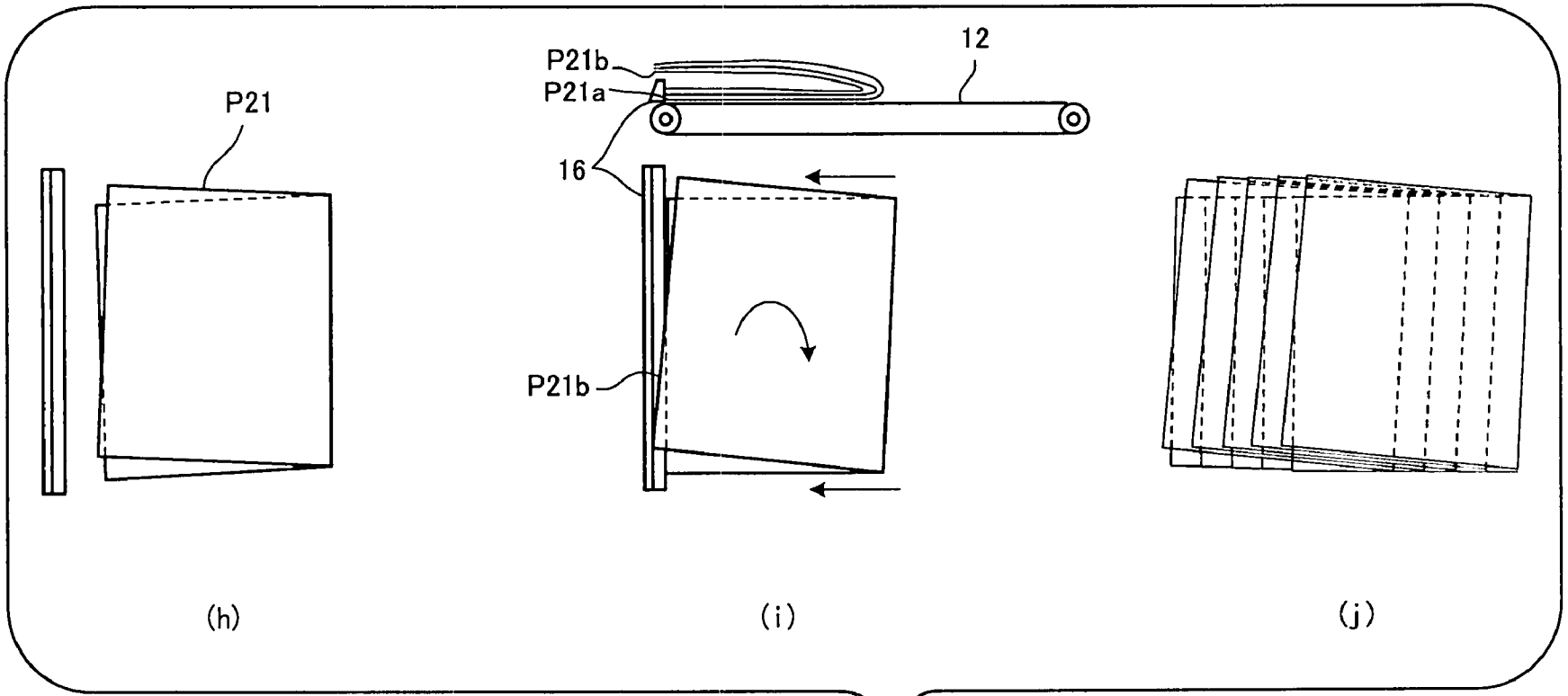
FIG. 7 is a view schematically showing a state in which an orientation of the booklet is corrected by the stacker.

FIG. 7 is a view schematically showing a state in which an orientation of the booklet is corrected by the stacker.

Part (h) to Part (j) of FIG. 7 show the state in which the orientation of the booklet is being corrected. Part (h) of FIG. 7 shows the state in which a booklet P21 is carried out from the carry-out roller. In this case, when the accuracy of the sheet folding position is low in the booklet finisher 7 that produces the booklet P21, the sheets are not aligned with one another at the edge of the booklet P21.

As shown in Part (i) of FIG. 7, when the booklet P21 is once returned to the upstream side in the transfer direction by the transfer belt, the booklet P21 abuts on the orientation correcting unit 16. At this point, in the sides constituting the edges of the booklet P21, when a side P21*a* on the belt side abuts on the orientation correcting unit 16, the orientation of the booklet P21 is corrected such that the side P21*a* is perpendicular to the transfer direction. In this case, the side P21*b* on the side opposite to the belt side of the booklet P21 is orientated toward an oblique direction with respect to the transfer direction.

Then, in the state in which the plural booklets are arranged on the transfer belt 12, the orientations of all the booklets are aligned, and the alignment state is kept to a certain extent as shown in Part (j) of FIG. 7. However, when viewed from the user, because the orientations of the sides of the booklets are orientated toward the oblique direction with respect to the transfer direction, the loading quality of the booklets is not so good.

Figure 8:
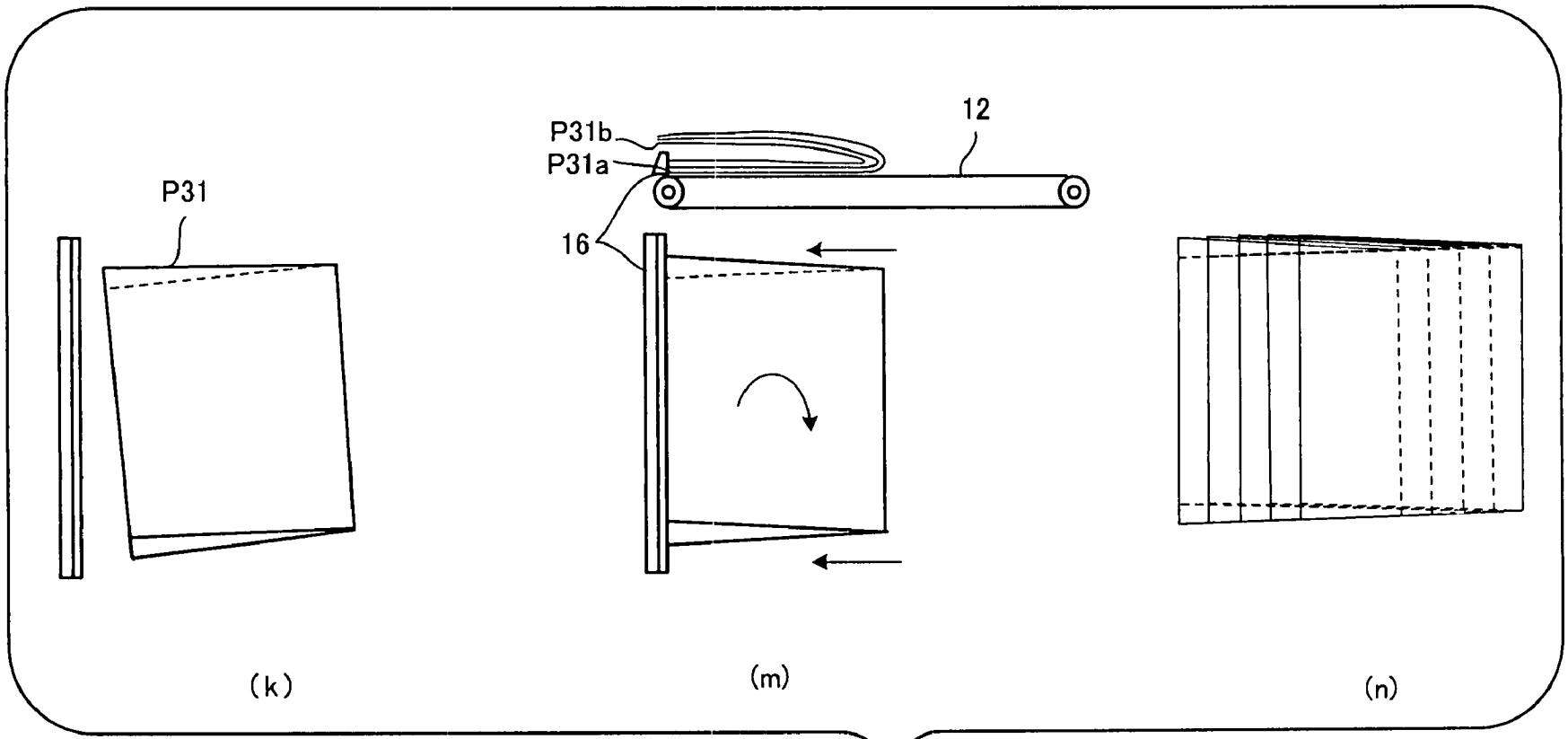
FIG. 8 is a view schematically showing a state in which the orientation of the booklet is corrected by the stacker.
Figure 9:
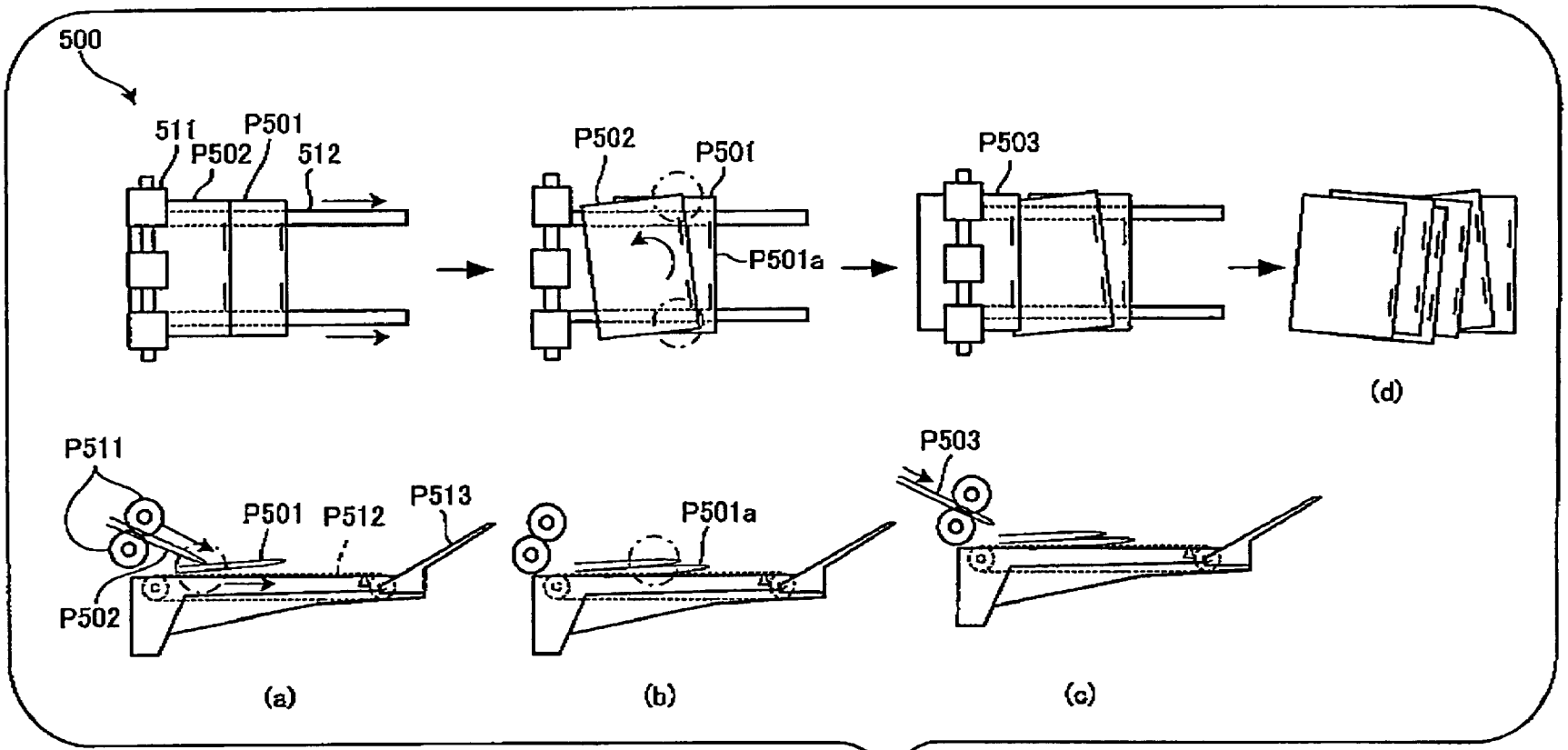
Fig. 9 (Prior Art)
FIG. 9 is a view showing a state in which the booklet is loaded by a conventional booklet loading apparatus.

FIG. 8 is a view schematically showing a state in which the orientation of the booklet is corrected by the stacker.

Part (k) to Part (n) of FIG. 8 show the state in which the orientation of the booklet whose edge is cut and aligned by the trimming machine 8 is corrected.

Part (k) of FIG. 8 shows the state after a booklet P31 is carried out from the carry-out roller. At this point, because the side of the edges of the booklet P31 is cut and aligned by the trimming machine 8, the orientations of sheets are aligned with one another at the edge of the booklet P31 even if the accuracy of the position where the sheet is folded by the booklet finisher 7 is low.

As shown in Part (m) of FIG. 8, when the booklet P31 is once returned to the upstream side in the transfer direction, a side P31*a* on the belt side in the sides constituting the edge of the booklet P31 abuts on the orientation correcting unit 16. Therefore, the orientation of the booklet P31 is corrected such that the side P31*a* is perpendicular to the transfer direction. In this case, a side P31*b* on the side opposite to the belt side of the booklet P31 is also orientated toward the direction perpendicular to the transfer direction.

As a result, in the case where the plural booklets are arranged on the transfer belt 12, as shown in Part (n) of FIG. 8, the orientations of all the booklets are aligned, and the orientation of the booklet side that can be seen from the user becomes perpendicular to the transfer direction. Accordingly, the loading quality is high when viewed from the user.

Thus, the side of the booklet is cut and aligned, and the cut and aligned side is caused to abut on the orientation correcting unit. Then, the orientations of the booklets can be aligned even if the accuracy of the sheet folding position is low. Accordingly, the alignment state of the booklet is kept well, and the loading quality is high when viewed from the user.

In the embodiment, the control circuit 26 is incorporated into the image forming apparatus 2. However, the invention is not limited to the embodiment. For example, the control circuit may be mounted on the stacker.

In the embodiment, the carry-out roller 11 is incorporated into the square folding device 9. However, the invention is not limited to the embodiment. For example, the carry-out roller may be mounted on the stacker.

In the embodiment, the stacker 10 includes the transfer belt 12 and the loading tray 13 that regulates the movement of the booklet. However, the transfer unit of the invention is not limited to the embodiment. For example, the loading unit of the invention may include a tray integrally formed with the transfer unit, and the booklet may be transferred and loaded by moving the tray.

In the embodiment, the orientation correcting unit 16 is formed in the rod shape. However, the invention is not limited to the embodiment, but the orientation of the booklet may be corrected to a predetermined direction by causing the booklet to abut. For example, the orientation correcting unit may be formed by plural projections arranged along the surface perpendicular to the transfer direction.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A booklet loading apparatus comprising:

a carry-out unit that sequentially carries out a plurality of booklets to a carry-out position;

a transfer belt that transfer the booklets, carried out from the carry-out unit, in a transfer direction by receiving the booklets sequentially at the carry-out position and moving with the booklets thereon, wherein directions of movement of the transfer belt are changeable between a first movement direction corresponding to transfer of the booklets in the transfer direction and a second movement direction corresponding to transfer of the booklets in the opposite direction to the transfer direction;

a control unit that controls movement of the transfer belt, wherein the control unit (a) makes the transfer belt move intermittently in synchronization with a timing when the booklet is carried out from the carry-out unit so that the booklets, carried out from the carry-out unit, are sequentially arranged on the transfer belt while the booklets overlap one another, and (b) makes the transfer belt move in the second direction once in each time when the booklet is carried out from the carry-out unit to the transfer belt and then makes the transfer belt move in the first direction so that the booklet, carried out from the carry-out unit, is transferred in the transfer direction after the booklet is returned once to an upstream side in the transfer direction with respect to the carry-out position;

a loading unit on which the booklet transferred out by the transfer belt is loaded; and an orientation correcting unit that is arranged on the upstream side in the transfer direction with respect to the carry-out position, the orientation correcting unit correcting an orientation of the booklet to a predetermined orientation by being abutted by the booklet returned to the upstream side in the transfer direction by the transfer belt moving in the second direction.

2. A booklet loading apparatus according to claim 1, wherein the loading unit raises the booklet by regulating movement of the booklet transferred by the transfer unit, and the raised booklet is loaded.

3. A booklet loading apparatus according to claim 1, wherein the booklet is loaded on the booklet loading apparatus, a side of the booklet being cut and aligned by a device including a trimming unit, the trimming unit cutting and aligning the side of the booklet, the carry-out unit carries out the booklet whose side is cut and aligned by the trimming unit to the carry-out position while the cut and aligned side of the booklet is orientated toward the upstream side in the transfer direction, and the orientation correcting unit is abutted by the side of the booklet cut and aligned by the trimming unit.

4. A post-treatment apparatus comprising:

a bookbinding unit that binds a booklet from sheets in which images are formed;

a carry-out unit that sequentially carries out the plurality of booklets to a carry-out position, the booklets being bound by the bookbinding unit;

a transfer belt that transfer the booklets, carried out from the carry-out unit, in a transfer direction by receiving the booklets sequentially at the carry-out position and moving with the booklets thereon, wherein directions of movement of the transfer belt are changeable between a first movement direction corresponding to transfer of the booklets in the transfer direction and a second movement direction corresponding to transfer of the booklets in the opposite direction to the transfer direction;

a control unit that controls movement of the transfer belt, wherein the control unit (a) makes the transfer belt move intermittently in synchronization with a timing when the booklet is carried out from the carry-out unit so that the booklets, carried out from the carry-out unit, are sequentially arranged on the transfer belt while the booklets overlap one another, and (b) makes the transfer belt move in the second direction once in each time when the booklet is carried out from the carry-out unit to the transfer belt and then makes the transfer belt move in the first direction so that the booklet, carried out from the carry-out unit, is transferred in the transfer direction after the booklet is returned once to an upstream side in the transfer direction with respect to the carry-out position;

a loading unit on which the booklet transferred out by the transfer belt is loaded; and an orientation correcting unit that is arranged on the upstream side in the transfer direction with respect to the carry-out position, the orientation correcting unit correcting an orientation of the booklet to a predetermined orientation by being abutted by the booklet returned to the upstream side in the transfer direction by the transfer belt moving in the second direction.

5. The booklet loading apparatus according to claim 4, wherein the orientation of the booklet being an orientation of the booklet in which the each loaded booklet is shifted from one another.

6. An image forming system comprising:

an image forming unit that forms an image on a sheet;

a bookbinding unit that binds a booklet from the sheets in which the images are formed;

a carry-out unit that sequentially carries out the plurality of booklets to a carry-out position, the booklets being bound by the bookbinding unit;

a transfer belt that transfer the booklets, carried out from the carry-out unit, in a transfer direction by receiving the booklets sequentially at the carry-out position and moving with the booklets thereon, wherein directions of movement of the transfer belt are changeable between a first movement direction corresponding to transfer of the booklets in the transfer direction and a second movement direction corresponding to transfer of the booklets in the opposite direction to the transfer direction;

a control unit that controls movement of the transfer belt, wherein the control unit (a) makes the transfer belt move intermittently in synchronization with a timing when the booklet is carried out from the carry-out unit so that the booklets, carried out from the carry-out unit, are sequentially arranged on the transfer belt while the booklets overlap one another, and (b) makes the transfer belt move in the second direction once in each time when the booklet is carried out from the carry-out unit to the transfer belt and then makes the transfer belt move in the first direction so that the booklet, carried out from the carry-out unit, is transferred in the transfer direction after the booklet is returned once to an upstream side in the transfer direction with respect to the carry-out position;

a loading unit on which the booklet transferred out by the transfer belt is loaded; and an orientation correcting unit that is arranged on the upstream side in the transfer direction with respect to the carry-out position, the orientation correcting unit correcting an orientation of the booklet to a predetermined orientation by being abutted by the booklet returned to the upstream side in the transfer direction by the transfer belt moving in the second direction.

7. The booklet loading apparatus according to claim 6, wherein the orientation of the booklet being an orientation of the booklet in which the each loaded booklet is shifted from one another.

8. The booklet loading apparatus according to claim 1, wherein the orientation of the booklet being an orientation of the booklet in which the each loaded booklet is shifted from one another.

* * * * *